United States Patent [19]

Steinemann

[11] Patent Number: 4,911,762

[45] Date of Patent: Mar. 27, 1990

[54] INTERMETALLIC COMPOUND, METHOD FOR PRODUCING THE COMPOUND, AND USE OF THE COMPOUND

[76] Inventor: Samuel Steinemann, 14, Chemin des Codoz, CH-1025 St. Sulpice, Switzerland

[21] Appl. No.: 159,326

[22] Filed: Feb. 23, 1988

[30] Foreign Application Priority Data

Mar. 10, 1987 [CH] Switzerland ..... 876/87

[51] Int. Cl.[4] ..... C22F 1/00

[52] U.S. Cl. ..... 148/2; 148/11.5 P; 148/13; 148/400; 148/425; 148/426

[58] Field of Search ..... 148/400, 425, 426, 2, 148/13, 11.5 P

[56] References Cited

PUBLICATIONS

Zeits, Metallkunde 71, 1980, p. 577.

*Primary Examiner*—R. Dean

*Attorney, Agent, or Firm*—Toren, McGeady & Associates

[57] ABSTRACT

Jewelry is produced employing alloys of Fe, Co, Ni, Pd, Pt, Au, as well as —in smaller quantities—Cu, in conjunction with Al, Ga, In, Si, these alloys displaying the feature of being crystallized in the cubic structure of the type B2 or C1, designations as used in structure reports. These alloys, which display very decorative colors not found with other metals, or anywhere else in nature, are—per se—very brittle and subject to spontaneous disintegration in reactive media. For this reason, these materials are very difficult to form and cannot be used for the intended purpose. Their properties can be decisively improved by impressing upon the alloys a grain size of less than 50 μm by hot-forming or by sintering, for example, or by some other process, and by selecting the composition of the alloy with the intent to keep the quantity of the transition metal component A at a value not lower than stochiometric value. The jewelry items may consist of one of these alloys, fully or partially.

16 Claims, No Drawings

INTERMETALLIC COMPOUND, METHOD FOR PRODUCING THE COMPOUND, AND USE OF THE COMPOUND

BACKGROUND OF THE INVENTION

1. Field of the Invention

The present invention refers to a compound of a group of compounds, each compound of the group consisting of a metallurgical combination of two or more component metals and having its specific composition and associated color. Such compounds are commonly referred to as alloys or as intermetallic compounds. The invention equally concerns a method for producing the compound of the invention, as well as the use of the compound for the manufacture of jewelry and other adorned products.

In the following each component will be referred to by its chemical symbol as appearing in the Periodic Table of Elements, e.g. Fe for iron, Au for gold, Cu for copper, etc., and each intermetallic compound will be identified by its constituent components, whereby associated coefficients and subscripts are used in conventional manner to refer to relative quantities of the components involved. Otherwise, compositions will be given in atomic %, if not stated differently.

2. Description of the Prior Art

Among the many varieties of existing intermetallic compounds some are known to display beautiful characteristic colors. A known example of such a compound is $AuAl_2$, an alloy that has been tried to be used for the manufacture of jewelry items, watch cases, etc., at various occasions. The properties of this alloy have been described in the literature (e.g. in Zeits. Metallkunde 17, 1980, page 577) as follows: "An interesting alloy made of Au and Al is the intermetallic compound $AuAl_2$, because of its unusual purple color. Like many other intermetallic compounds, $AuAl_2$ is very brittle and hard at room temperature, quite resistant against oxidation and consequently not simple to form. If stored for a few weeks in the laboratory, it spontaneously disintegrates." The suggestion has been made in DE-PS No. 659 155, to add aluminum or some other soft metal to the compound $AuAl_2$, to reduce its brittleness. The attempt has also been made to apply the metal by plasma spray or to generate a coat by chemically diffusing Al in Au. However, in such processes the reactions cannot be controlled adequately, and the metal becomes porous. Thus, the attempt to obtain a colored gold-alloy to be used for making jewelry items, has not been successful so far. Other colored intermetallic compounds have also been known, such as $PtAl_2$, NiAl, CoAl, NiGa, PdIn or $CoSi_2$. $PtAl_2$ and CoAl are yellow, NiAl is blue, PdIn red, and $CoSi_2$ blue-black. These metals, too, are usually brittle; therefore, the decorative effect of their colors cannot be put to use in the manufacture of jewelry. In addition, several of the aforementioned compounds, for example $AuAl_2$, tend to spontaneously disintegrate in reactive media.

SUMMARY OF THE INVENTION

Hence from what has been explained heretofore it should be apparent that the art is still in need of an intermetallic compound not associated with the aforementioned drawbacks and limitations of the state-of-the-art proposals.

It is therefore a primary object of the invention to provide a novel intermetallic compound which fails to show the disadvantages of the prior art as heretofore discussed and which effectively and reliably fulfills the existing need in the art.

Another and more specific object of the present invention relates to new intermetallic compound, which is not brittle and hard at room temperature, is easy to form and can be kept in storage without spontaneously disintegrating.

A further significant object of the invention refers to a method for producing the intermetallic compound, the method to yield a product having the required properties of strength, deformability, sufficient toughness and decorative features, to make it suitable for use in the manufacture of jewelry and of adorned metal products.

Yet a further significant object of the invention relates to the use of the intermetallic compound in the manufacture of jewelry and of adorned metal products.

The foregoing and other objects are attained in accordance with one aspect of the present invention through the provision of an intermetallic compound of the formula AB or $AB_2$, in which A is one of the elements iron (Fe), cobalt (Co), nickel (Ni), palladium (Pd), platinum (Pt), gold (Au), or any other mixture of these elements, anyone of these elements being replaceable by copper (Cu) up to 15 atom-percent, and Bis one of the elements aluminum (Al), gallium (Ga), indium (In), silicon (Si), or a mixture of these elements. A may be present in the compound in a quantity up to 15 atom-percent above the stoichiometric value, and the compound AB or $AB_2$ may contain up to 1 atom-percent impurities and additives. Furthermore, the compound has a cubic crystal structure of the type CsCl/B2 or $CaF_2$/Cl (CsCl and CaF2 are prototype structures and B2 and Cl are designations according to structure report), and a grain size of less than 50 $\mu$m.

In accordance with another aspect of the invention there is provided a method for producing the intermetallic compound, the method comprising at least one step for impressing upon the compound the required grain size of less than 50 $\mu$m. In this step, a cast alloy of the components may be hot-formed or deformed at a temperature lying between 45 and 90 percent of the temperature of solidification or phase formation of the intermetallic phase, as measured in degrees Kelvin, the degree of deformation being not less than 6. As a further possibility, the cast alloy may be deformed in a forging or hot-pressing process, or it may be formed of powder in a powder-metallurgical pressing and sintering process.

Claim is made, furthermore, for the use of the compound for producing jewelry or adorned metal products, as well as for jewelry comprising the compound of the invention, and for adorned metal products comprising adornment made of the compound of the invention.

A few of the advantages of the invention are described in the following.

By impressing upon the intermetallic compound a grain size of less than 50 $\mu$m by suitable metallurgical processes, brittleness, low fracture toughness and reduced deformability may be overcome. Any "plague effect" or spontaneous disintegration may be similarly avoided by selecting the composition as prescribed and by suitably heat-treating the compound. A wide range of decoratively colored compounds maybe obtained, thus providing particularly suitable materials for the manufacture of jewelry and for the adornment of jewelry items and of other products.

DETAILED DESCRIPTION OF THE PREFERRED EMBODIMENTS

The brittle behavior of intermetallic compounds is more the rule than the exception and is caused by the special microscopic elongation processes that take place in these metals having ordered atomic structures. The brittleness manifests itself as reduced elongation to fracture and as low value of fracture toughness. As an additional effect, these metals have low impact strength and low notch resistance and are easily scratched. Results have shown that these disadvantageous properties may be suppressed to a large degree by impressing upon the compound a grain size of less than 50 μm by suitable metallurgical processes.

This fine structure required for the compound of the invention may be achieved by hot-forming, for example by forging or hot-pressing. In this case the temperature of forming is to lie between 45% and 90% of the solidification or phase formation temperature, as measured in degrees Kelvin. Powder metallurgical method may also be employed. Such a method involves applying pressure onto powders and sintering these subsequently at medium to high temperatures. One may start out with powders of the components, in which case the reaction will take place during sintering (so called reactive sintering), or else with powders of the intermetallic compound obtained by suitable processes, such as by mechanical pulverization or by atomizing the melted mass to small particles. Pressure is applied to advantage during or after sintering (pressure sintering or hot isostatic pressing) to increase product density. With inter/metallic compounds the reaction is exothermic in most cases, especially so for CoAl, NiAl, PdIn, PtAl and $AuAl_2$. The developed heat may suffice for at least partially melting the mass. This is of considerable interest if reactive sintering is used, in which case a high-density product is obtained. Additional possibilities for producing the fine-grained structure consist in quenching the material directly and rapidly—from the liquid state, or by applying it in layers by sputtering. All these methods aimed at obtaining the fine-grained structure may be rendered more efficient by adding certain foreign elements in concentrations below 1%. Such additions and their reaction products may precipitate at the grain boundaries and block grain growth. Such additions may have the additional effect of improving the toughness properties of the material.

The aluminides and the silicides of the transition metals usually show good resistance to oxidation, particularly at high temperatures. However, aluminides and silicides, as well as compounds containing gallium and indium may be subject in reactive (oxidizing, gaseous and liquid) media to a special type of attack of oxidation or corrosion, leading to a catastrophic disintegration of the metal to powder. This phenomenon is known as the "plague effect" or disintegration. The phenomenon is known to occur at room temperature for the compounds FeAl, NiAl, NiGa, and $AuAl_2$, for example. Other compounds may be subject to the same phenomenon at other temperature ranges. Investigations show, however, that the phenomenon, which makes any practical application of such compounds impossible, may be rendered ineffective under certain conditions. For the compounds of the invention these conditions are as follows:

(a) The alloys shall not be sub-stoichiometric, meaning that the component A shall be present in the compound AB in a quantity amounting to at least 50 atom-percent, whereas in the compound $AB_2$ the component A shall be present in a quantity amounting to at least $33\frac{1}{3}$ atom-percent (A being a transition element component, including substitute elements, if required), (b) the poly-crystalline metal shall display a large granular surface, meaning that the grain size be small and lie below 50 μm and, if required, (c) the material be heat-treated at medium to high temperatures and finally quenched.

The first requirement restricts the composition range of the compound, and the second—imperative—requirement is identical to that known to improve ductility and fracture toughness. If these process steps turn out to be insufficient for suppressing the "plague effect", then the special heat-treatment under (c) is to be applied.

Metals and alloys usually contain small quantities of impurities. In most cases these foreign elements exert no significant influence upon the properties of the metal. However, certain kinds of such impurities may have deleterious effects, such as causing brittleness (mechanical effect and "plague effect"). Others, on the contrary, may exert beneficial effects, by strengthening cohesion within and between the grains or by preventing—or at least slowing down—grain growth at high temperatures. The deleterious impurities must therefore be held in their content below specified limits, while the beneficial ones are intentionally added to the alloy. In the case of intermetallic compounds based upon Fe, Co, Ni, Pd, Pt, Au, the impurities of Sn, Pb, P, S, the semi-metals of the groups Va and VIa of the Periodic System are to be limited to less than 0.1%. In contrast thereto, the elements Ti, Zr, Sc, Y, Cr, Mo, B and several others may have beneficial effects; they are added in quantities of several tenths of one percent. At these concentrations—and up to a total of 1%—the color effects of the compounds are not subject to any change.

The alloys under discussion are especially interesting, since these intermetallic compounds are suited to lend color to items of jewelry, an approach not used anywhere else. The attached Table 1 gives an overview of 12 colored compounds that exist, are stable, and fulfill the requirements (a) and (b) of claim 1. Table 2 lists four additional compounds that exist only at high temperatures, but may be held—by quenching—in a metastable condition. Those combinations not listed in the Tables (1) and (2) either fail to exist altogether as compounds of the formula AB or $AB_2$, or they display a crystalline structure different from either of the required two types of cubic crystalline structures. In this latter case the color effect is absent.

The intermetallic compounds of interest do not necessarily have a definite composition but may exhibit a certain range of existence for the phase. This range of existence is listed in Table 1. If the composition changes within the range of existence of the phase, then the color of the metal may also undergo a change. For example, the alloy 50Ni50Al is blue, but 60Ni40Al is yellow; 50Pd50In is red, but 60Pd40In is yellow. On the other hand, it is true for different compounds, that the A-elements may at least be partially substituted among themselves, or the B-elements may at least be partially substituted among themselves, so that influence may be exerted upon the color effects. Some examples are:

The systems FeAl—NiAl, CoAl—NiAl, NiAl—NiGa, $CoSi_2$—$NiSi_2$, and others are fully mixable.

In the system NiAl the aluminum may be replaced by silicon, with the effect, that Ni(AlSi) assumes a blue-green hue (color, chromaticity).

The system PdIn and PdAl are partially mixable and the structure type CsCl/B2 remains preserved at room temperature.

in the phase $AuAl_2$, Au may be partially replaced by Pt or Cu, with the consequence, that the purple color recedes, and red and yellow hues make their appearance. In this same compound the aluminum (Al) may be replaced by Si up to about 8 atom-percent.

In the systems $CoSi_2$ and $NiSi_2$, Si may be replaced up to about 30 atom-percent by a corresponding quantity of Al. Within a certain range of composition the system $Ni(SiAl)_2$ of a structure of the type $CaF_2$/Cl may coexist with Ni(AlSi) of a structure of the type CsCl/B2.

In the system NiAl, NiGa, CoAl, PdAl, etc., the transition metal may be replaced by Cu up to about 20 atom-percent, with the effect, that the system (NiCu)Al will assume a blue-green or a yellow reddish hue, dependent upon the content of Ni plus Cu.

In systems with several components the color effect that characterizes the binary compounds exists only for the structure types CsCl/B2 and $CaF_2$/Cl. The existence range of these two phases, including any substitution of the components A or B in the corresponding formula AB or $AB_2$, can also be specified as limits of the so-called electron concentration. The electron concentration e/a is defined as the sum of the valence electrons per atom of the compound. Specifically, $$\frac{e}{a} = \frac{1}{100} - \Sigma\, a_i v_i,$$

where $a_i$ is the concentration in atom-percent and $v_i$ is the number of valence electrons of the component i. According to Hume-Rothery: v=0 for Fe, Co, Ni, Pd, Pt; v=1 for Au, Cu; v=3 for Al, Ga, In; and v=4 for Si. The stoichiometric AB-compounds of the Tables 1 and 2 all have e/a=1.5; for the stoichiometric $AB_2$-compounds $PtAl_2$, $PtGa_2$, $PtIn_2$, e/a=2; for $AuAl_2$, $AuGa_2$, $AuIn_2$, e/a=$2\frac{1}{3}$; and for $CoSi_2$, $NiSi_2$, e/a=$2\frac{2}{3}$. Taking into account the ranges of existence listed in Table 1 and the substitutions of the elements A and B mentioned before as examples, as well as the restriction that—in regards to the component A—the compound must not be present in quantities below stoichiometric value, there exists for the AB-compounds a range of electron concentrations e/a of approximately 1.1–1.7 in which the structure of the type CsCl/B2 is stable. This restriction in regards to the stoichiometry considerably narrows the range of e/a-values. As regards the $AB_2$-compounds, under the inclusion of the substitutions listed, the ratio e/a is 2.0–$2\frac{2}{3}$, in which the structure of the type $CaF_2$/Cl is stable. The electron concentration thus establishes a relation between the chemical nature of the components and the crystalline structure of the compound, the latter being the property that decisively determines whether the wanted color effects will or will not show up.

Various intermetallic compounds according to the invention attain a value of penetration hardness (Vickers hardness) from 4000 to more than 6000 N/mm2 (Table 1). This makes the materials of the invention of interest for he manufacture of jewelry, because such values of hardness are sufficiently high to yield high values of resistance against abrasion and scratching. Let it be pointed out—for the purpose of comparison-that stainless steel and the gold alloys possess a penetration hardness of between 1500 and 2500 N/mm2. However, due to the high value of hardness, the intermetallic compounds are unsuited to be worked by conventional methods like sawing, turning, milling and drilling; instead, they may be more adequately shaped by grinding, electro-erosion, electrochemical machining, etc., or else by die-forging at medium to high temperatures. Powder-metallurgical methods are eminently suited for their simple and direct shaping.

Table 1 lists density values of intermetallic compounds of interest. Some of these metals have small density values as compared to the density of stainless steel of 8 g/cm$^3$, or to the density of gold alloys of 15 g/cm$^3$. Jewelry items should not be weighty, and in case of noble metal alloys, low density involves cost advantage.

All in all, there exist three reasons that contribute to making the intermetallic compounds of the invention interesting for use in the manufacture of jewelry items, namely, the novel color effects of such metals, their high resistance against oxidation corrosion and abrasion as well as their low density values.

The alloys of the NiAl-system are interesting for their variable color effects. They are as follows: 50.2Ni49.-8Al blue, 50.2Ni+40Al19.8Si blue-green, 60Ni4OAl yellow, 54Ni6Cu4OAl yellow-red, 62Ni38Al yellow. The compositions are higher than stoichiometric, to safely suppress the grain boundary brittleness. The last-mentioned composition even goes beyond the range of existence of the NiAl-phase; in the course of heat treatment (600°–800° C.) a small quantity of $Ni_3Al$-phase will be precipitated and thus the strength and the resistance to fracture will be significantly increased.

The alloys of the NiAl-system are melted to advantage in an induction furnace under vacuum conditions or in an atmosphere of argon. By hot-forging or hot-pressing, the metal becomes homogenized and rendered fine-grained (encapsulated, to avoid oxidation). The degree of deformation (reduction in cross-section) is 6 or more, while the temperature of forming is not to exceed 1200° C., if the grain size is to be smaller than 50 μm (1000° C. for grain sizes smaller than 20 μm). Stress-relief annealing may be carried out at about 800° C., if required. If manufacturing is done by sintering, the starting material may be the alloy in powder form, or a mixture of powders of the components of the alloy. If reactive sintering is carried out, incipient melting allows the achievement of higher density. The reaction temperatures required for sintering lie between 600°°C. and 1200° C.

The PdIn-system, too, displays variable color effects, specifically, 50.2Pd49.8In red, 60Pd40I yellow. In this system the A-component may be partially substituted by Ni, Cu or Au, and the B-component by Al or Si, yielding for example: 43Pd7.2Cu49.8In red, 50.2Pd 3.8In10Al red, 57Pd36In7Si yellow. The hardness values of such multi-component systems lie higher than those of binary compounds. Hot deformation is carried out at temperatures lying between 1000° C. and 600° C., to conserve the fine-grained structure. This temperature also corresponds to the temperature at which the material may suitably be sintered.

In the cast condition the alloy $AuAl_2$ is exceedingly brittle and subject to the "plague effect". The alloys of this system can only be used if the A-component is present in excess, if impurities casing brittleness are absent, and if the structure is fine-grained. The compound is plastically deformable at temperatures of 400°

C. and higher. On the other hand, the practical upper limit for heat-treatments, in particular for hot-forging or hot-pressing, for the purpose of grain-size reduction, is the temperature 625° C., that corresponds to the melting point of the neighboring phase AuAl. If sintering is used as a production method, one may start out with the components or with the compound as raw material, and use temperatures between 500° and 900° C.; in the first case, the heat of reaction will cause partial melting, thus yielding a product largely free of pores. The compounds of interest in this system are 34Au66Al (79% Au by weight) purple, and 31Au3Cu66Al (75% Au by weight) purple. Other possible elements that may be used as substitutes are Ni and Pt for the component A and up to 8 atom-percent Si for the B-component.

$PtAl_2$ is a chemically very resistant and hard compound of bright yellow color and of a density that lies below that of stainless steel. A suitable composition for the compound is 34Pt66Al (79% Pt by weight). The metal may worked at temperatures between 1150° C. and 800° C. Sintering may suitably be performed at temperatures between 600° C. and 1200° C.

The compounds $AuGa_2$ and $AuIn_2$ have a bright blue color. They have low solidification temperatures and are soft, and therefore of low resistance to abrasion. Their use is limited to non-exposed parts of jewelry, such as watch dials.

The silicides of Co and Ni are hard and fracture resistant, and their blue-black color is decorative as a contrast color. The compounds of interest have the composition 34Ni66Si and 34Co66Si. Ni and Co can be substituted one against the other; alternately, up to about 10 atom-percent Ni or Co may be replaced by Fe or Cu. Hot-forging or hot-pressing, as well as powder sintering are carried out in the temperature range 1225° to 800° C. for the Co-compound, and below 966° C. for the Ni-compound (eutectic reaction of the phases containing more Ni).

The intermetallic compounds, such as $CoSi_2$, NiAl, PdIn, may also be applied as coatings. A suitable process for this purpose is sputtering (in He or by Ar-discharge). Fine-grained, thick layers (of 10 μm or more) of sufficient ductility may be obtained, if the deposition takes place on a heated substrate (of stainless steel, for example). Rapid quenching from the liquid state may also be used, if conducted in a non-oxidizing atmosphere (He, Ar) or under vacuum.

The colored intermetallic compounds may be bonded to other metals, such as brass, steel, titanium, etc.

The brazing metal and the corresponding process are to be selected so as to prevent excessive recrystallization of the material, by using for example brazing materials having melting points below 900° C. for NiAl, $PtAl_2$, $CoSi_2$, etc., and below 600° C. for $AuAl_2$.

A color effect is always a function of the surface finish of the object. Optical properties of metals are usually described as the specular reflection on polished, radiant surfaces. In actual truth the sources of light are punctiform as well as diffuse, and polished surfaces show different effects than rough surfaces; the rough, ground, or chemically etched surface appears much brighter than the polished surface. The effect is particularly conspicuous on the blue compounds NiAl or $CoSi_2$, but less marked on the yellow and red metals. Furthermore, mechanical deformations, such as those due to grinding and polishing, may disturb the formation of color and yield gray hues. This undesirable effect can be corrected, for example by annealing the compounds at medium temperatures below recrystallization or by chemical etching away the damaged surface layer. Surface treatment plays an important role in the use of colored metals.

While there is shown and described present preferred embodiments of the invention, it is to be distinctly understood that the invention is not limited thereto but may be otherwise variously embodied and practiced within the scope of the appended claims.

TABLE 1

| Compound | Color | Structure (Type designation as per structure report) | Existence range of phase, atom-percent of component A | Solidification or phase formation temperature, °C. | Density g/cm³ | Impression hardness N/mm² |
|---|---|---|---|---|---|---|
| FeAl | brownish | CsCl/B2 | 49–66 | 1090–1310 | approx. 6 | 5000 |
| CoAl | yellow | CsCl/B2 | 47–58 | 1620–1650 | 6.1 | 4000 |
| NiAl | blue (1) | CsCl/B2 | 45–59 | 1580–1640 | 5.9 | 3500–5000 |
| CoGa | yellow | CsCl/B2 | 45–68 | 1000–1200 | 9.0 | |
| NiGa | pink | CsCl/B2 | 47–52 | 1000–1100 | 8.9 | |
| PdIn | red (2) | CsCl/B2 | 48–60 | 900–1290 | 10.6 | 1600–2200 |
| $PtAl_2$ | yellow | $CaF_2$/Cl | 31.5–33.5 | 1550 | 8.0 | 4000 |
| $AuAl_2$ | purple | $CaF_2$/Cl | 32.9–33.9 | 1060 | 7.7 | 3200–5000 |
| $AuGa_2$ | blue | $CaF_2$/Cl | 33⅓ | 490 | 10.0 | 800 |
| $AuIn_2$ | blue | $CaF_2$/Cl | 33⅓ | 540 | 10.3 | 600–800 |
| $CoSi_2$ | blue-black | $CaF_2$/Cl | 32–34 | 1330 | 4.9 | 6300 |
| $NiSi_2$ | blue-gray | $CaF_2$/Cl | 32–34 | 980 | 4.8 | 6000 |

(1) if Ni in excess: yellow
if Ni partially replaced by Cu: blue-green
if Al partially replaced by Si: blue-green
(2) if Pd in excess: yellow

TABLE 2

| Compound | Color | Structure (Type designation as per structure report) | Stable at temperatures higher than | At lower temperatures |
|---|---|---|---|---|
| PdAl | | CsCl/B2 | 850° C. | change of phase |
| NiIn | violet (1) | CsCl/B2 | 770° C. | eutectoid disintegration |
| $PtGa_2$ | yellow (1) | $CaF_2$/Cl | 153° C. | eutectoid disintegration |
| $PtIn_2$ | yellow (1) | $CaF_2$Cl | 674° C. | eutectoid disintegration |

(1) in the quenched state

What is claimed is:

1. An intermetallic compound of the formula AB or $AB_2$, in which (a) A is an element selected from iron (Fe), cobalt (Co), nickel (Ni), palladium (Pd), platinum (Pt), gold (Au), or a mixture of these elements, any one of the elements being replaceable by copper (Cu) in an amount of up to 15 atom-percent and B is an element selected from aluminum (Al), gallium (Ga), indium (In), silicon (Si), or a mixture of these elements, wherein A may be present in the intermetallic compound in a quantity of up to 15 atom-percent above the stoichiometric value and the compound AB or $AB_2$ may contain up to 1 atom-percent of impurities, (b) in which the intermetallic compound has a cubic structure of the structure-report type B2 or C1 and (c) the intermetallic compound has a grain size of less than 50 μm.

2. The intermetallic compound according to claim 1, wherein the compound AB or $AB_2$ contains less than 0.1% impurities of Sn, Pb, P and S.

3. The intermetallic compound according to claim 1, wherein the compound AB or $AB_2$ contains up to a total of 1% of additive elements selected from Ti, Zr, Sc, Y, Cr, Mo, B and a combination thereof.

4. A method for manufacturing an intermetallic compound useful for jewelry comprising preparing a compound of the formula AB or $AB_2$, in which (a) A is an element selected from iron (Fe), cobalt (Co), nickel (Ni), palladium (Pd), platinum (Pt), gold (Au), or a mixture of these elements, any one of the elements being replaceable by copper (Cu) in an amount of up to 15 atom-percent and B is an element selected from aluminum (Al), gallium (Ga), indium (In), silicon (Si), or a mixture of these elements, wherein A may be present in the intermetallic compound in a quantity of up to 15 atom-percent above the stoichiometric value and the compound AB or $AB_2$ may contain up to 1 atom-percent of impurities, (b) in which the intermetallic compound has a cubic structure of the structure-report type B2 or C1 and subjecting the compound AB or $AB_2$ to a grain refining treatment in order to reduce the grain size to less than 50 μm.

5. The method for manufacturing an intermetallic compound according to claim 4, wherein the compound AB or $AB_2$ is prepared by casting and is then subjected to hot-deformation at a temperature between 45 and 90 percent of the temperature of solidification or phase formation of the intermetallic phase, as measured in degrees Kelvin, the degree of deformation being not less than 6.

6. The method for manufacturing an intermetallic compound according to claim 4, wherein the compound AB or $AB_2$ is prepared by casting and is than subjected to hot-deformation by forging or hot-pressing.

7. The method for manufacturing an intermetallic compound according to claim 4, wherein the compound AB or $AB_2$ is subjected to a heat treatment and is then rapidly quenched.

8. The method for manufacturing an intermetallic compound according to claim 4, wherein the compound AB or $AB_2$ is prepared from powder by powder-metallurgical pressing and sintering so that the resultant compound has a grain size of less than 50 μm.

9. The method for manufacturing an intermetallic compound according to claim 8, wherein the compound AB or $AB_2$ is prepared from powders of the elemental components by powder-metallurgical pressing and sintering, whereby the reaction to form the compound AB or $AB_2$ takes place during sintering and the resultant compound has a grain size of less than 50 μm.

10. The method for manufacturing an intermetallic compound according to claim 8, wherein the compound AB or $AB_2$ is powdered and then subjected to powder-metallurgical pressing and sintering so that the resultant compound has a grain size of less than 50 μm.

11. A method for producing jewelry or adorned metal products comprising producing the jewelry or adorned metal products from a compound defined in claim 1.

12. A method for producing jewelry or adorned metal products comprising producing the jewelry or adorned metal products from a compound defined in claim 2.

13. A method for producing jewelry or adorned metal products comprising producing the jewelry or adorned metal products from a compound defined in claim 3.

14. Jewelry comprising a compound claimed in claim 1.

15. Jewelry comprising a compound claimed in claim 2.

16. Jewelry comprising a compound claimed in claim 3.

* * * * *